United States Patent [19]

Aoyama et al.

[11] 4,352,344

[45] Oct. 5, 1982

[54] VALVE OPERATING MECHANISM FOR INTERNAL COMBUSTION ENGINES

[75] Inventors: Shunichi Aoyama; Kazuyuki Miisho, both of Yokohama, Japan

[73] Assignee: Nissan Motor Co., Ltd., Yokohama, Japan

[21] Appl. No.: 163,910

[22] Filed: Jun. 27, 1980

[30] Foreign Application Priority Data

Jul. 3, 1979 [JP] Japan ..... 54-84273

[51] Int. Cl.[3] ..... F01L 1/34

[52] U.S. Cl. ..... 123/90.18; 123/90.48

[58] Field of Search ..... 123/90.16, 90.17, 90.18, 123/90.27, 90.39, 90.48; 74/569

[56] References Cited

U.S. PATENT DOCUMENTS

| | | | |
|---|---|---|---|
| 2,678,641 | 5/1954 | Ryder | 123/90.16 |
| 2,823,655 | 2/1958 | Repko | 123/90.16 |
| 2,997,991 | 8/1961 | Roan | 123/90.16 |
| 4,182,289 | 1/1980 | Nakajima et al. | 123/90.18 |
| 4,205,634 | 6/1980 | Tourtelot | 123/90.16 |

FOREIGN PATENT DOCUMENTS

| | | | |
|---|---|---|---|
| 2037705 | 8/1973 | Fed. Rep. of Germany . | |
| 2629554 | 1/1978 | Fed. Rep. of Germany | 123/90.16 |
| 52-3913 | 1/1977 | Japan | 123/90.16 |

*Primary Examiner*—Craig R. Feinberg
*Assistant Examiner*—W. R. Wolfe
*Attorney, Agent, or Firm*—Thompson, Birch, Gauthier & Samuels

[57] ABSTRACT

A valve operating mechanism of an internal combustion engine comprises a first cam rotatable about an axis in timed relation to the engine speed, a rocker arm operatively engaged with the valve of the engine and rockable to open and control closing of said valve, a second cam rockable about an axis parallel to the axis of said first cam and interposed between the first cam and the rocker arm to provide an operative connection therebetween, the first and second cams having mating cam faces which taper axially thereof, and means for shifting one of the first and second cams axially thereof relative to the other thereby varying the angular position of the second cam independently of that of the first cam in response to variation of the engine operating condition whereby valve lift, valve timing and the period during which the valve is open are varied in accordance with the varying operating conditions of the engine.

3 Claims, 7 Drawing Figures

VALVE OPERATING MECHANISM FOR INTERNAL COMBUSTION ENGINES

BACKGROUND OF THE INVENTION

This invention relates to a valve operating mechanism for internal combustion engines and more particularly to an apparatus for varying the valve lift and timing in accordance with the varying operating conditions of the engine.

The customary internal combustion engine utilizes a valve operating mechanism constructed to control opening and closing of the intake and exhaust valves at timings which are fixed for the entire operating conditions of the engine in a manner to meet the requirements of the high-speed operating conditions of the engine. Such valve operating mechanisms, however, results in incomplete combustion of the mixture at idling and low engine speeds due to an excessively large valve overlap at such engine speeds, high pollution levels from the engine, marked deterioration of fuel economy and a loss in engine performance efficiency at idling and low engine speeds.

With a view to eliminating the above-mentioned problems, various valve operating mechanisms have heretofore been proposed which are operative to vary valve lift and timing, but difficiculties are still encountered in such variable valve operating mechanisms in being put to practical use due to their relatively complex and bulky construction and in controlling the valve timing strictly in accordance with the varying operating conditions of the engine. For example, a variable valve timing camshaft is known which has a relatively good practical usefulness but has difficulty in controlling the valve timing strictly in accordance with the varying operating conditions of the engine. Furthermore, the customary variable valve timing camshaft cannot vary the valve lift and valve opening period. The present invention is directed to the elimination of all these problems inherent in the prior art valve operating mechanisms of the type providing variable valve timing as well as of the type providing constant valve lift and timing.

SUMMARY OF THE INVENTION

It is, therefore, an important object of the present invention to provide a mechanism for controlling valve lift and timing in accordance with the varying operating conditions of an internal combustion engine, which has a simple and economical construction and which is readily controlled in strict relation to the varying operating conditions of the engine.

It is another object of the present invention to provide a valve operating mechanism of the above mentioned character which is operative to vary the period during which the valve is open.

It is a further object of the present invention to provide a valve operating mechanism of the above mentioned character which has an excellent practical usefulness.

It is a still further object of the present invention to provide a valve operating mechanism of the above mentioned character which is capable of varying the valve overlap in such a manner as to meet the varying requirements of the operating conditions of the engine, resulting in the highest possible performance and efficiency of the engine over the entire operating conditions of the engine.

In accordance with the present invention, such objects are accomplished basically in an apparatus which comprises a first cam rotatable about an axis in timed relation to the engine speed, a rocker arm operatively engaged with the valve of the engine and rockable to open and control closing of said valve, a second cam rockable about an axis parallel to the axis of said first cam and interposed between said first cam and said rocker to provide an operative connection therebetween, said first and second cams having mating cam faces which taper axially thereof, and means for shifting one of said first and second cams axially thereof relative to the other thereby varying the angular position of said second cam independently of that of said first cam in response to variations of the engine operating condition.

BRIEF DESCRIPTION OF THE DRAWINGS

These and other objects and advantages of a valve operating mechanism of an internal combustion engine according to the present invention will become more clearly understood from the following description taken in conjunction with the accompanying drawings, in which.

DESCRIPTION OF THE PREFERRED EMBODIMENT

Figure 1:
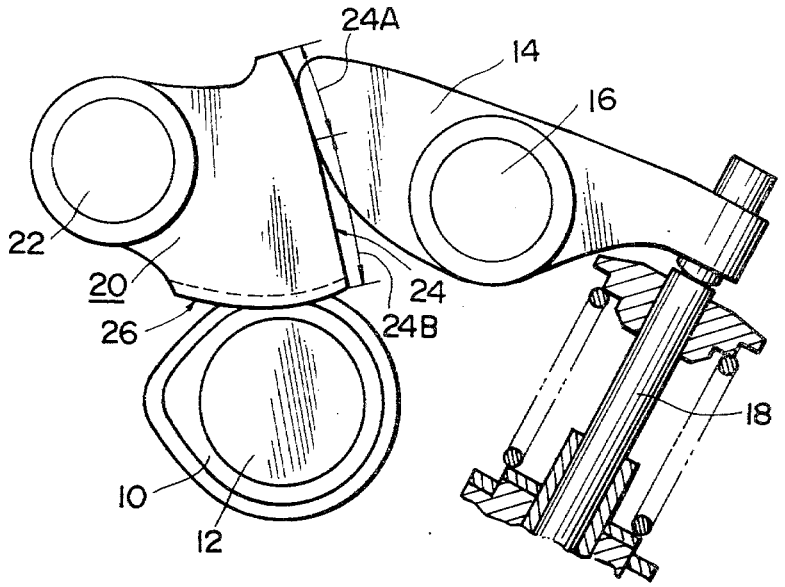
FIG. 1 is a front elevation partly in section showing a preferred embodiment of the valve operating mechanism according to the present invention.
Figure 2:
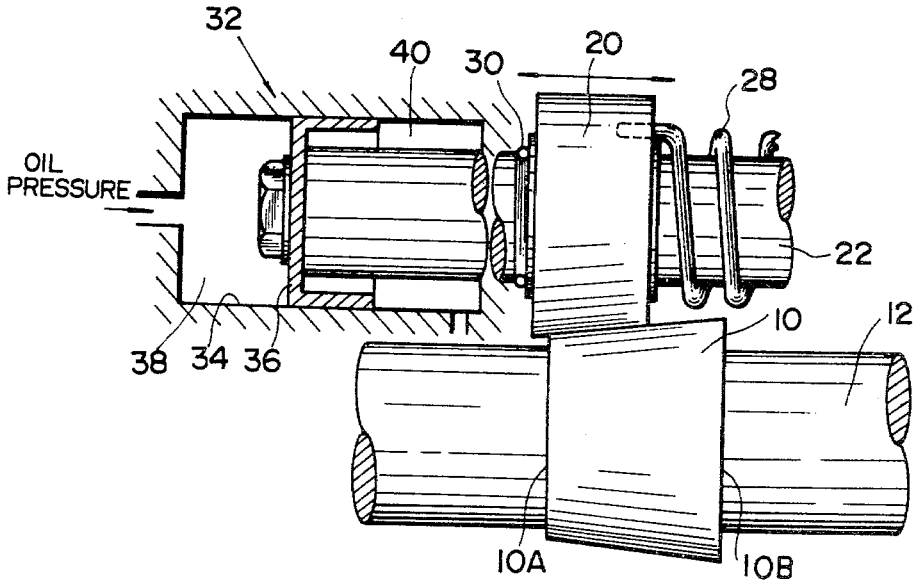
FIG. 2 is a side view partly in section showing the valve operating mechanism of FIG. 1.

Referring to FIGS. 1 and 2, the reference numeral 10 represents a first cam which is integral with a camshaft 12 and is rotatable with the camshaft 12 in timed relation to the rotation of an engine crankshaft (not shown), i.e., the engine speed. A rocker arm 14 is journaled intermediate its ends on a rocker shaft 16 in parallel relationship to the camshaft 12 and is operatively engaged at one end thereof with a poppet valve 18 (its lower end part is broken away) to open and control closing of the valve. Interposed between the other end of the rocker arm 14 and the first cam 10 is a second or rocking motion cam 20 which provides an operative connection therebetween. The second cam 20 is journaled on a camshaft 22 which is arranged in parallel relationship to the camshaft 12. The second cam 20 has a rocker arm-engaging cam surface section 24 and a first cam-engaging cam surface section 26. The rocker arm-engaging cam surface section 24 is perpendicular to a plane to which the axis of the camshaft 22 or the axis of rocking movement of the second cam 20 is perpendicular. The first cam-engaging cam surface section 26 is formed into a tapering configuration to make line-to-line contact with the first cam 10 which generally tapers axially from the end 10A of small circumferences to the end 10B of a relatively larger circumference. As seen from FIG. 1, the second cam 20 in this embodiment is formed into a wedge shape having faces which meet in a sharply acute angle and which constitute the above-mentioned cam surface sections 24 and 26, respectively. A return spring 28 is positioned around the camshaft 22 and fixedly attached at its ends to the second cam 20 and, though not shown, to the camshaft 22, respectively. The return spring 28 is assembled thereto in a preloaded condition in such a manner to urge the second cam 20 to make contact at the cam surface section 26 with the first cam 10, i.e., to urge the second cam 20 to rotate in the clockwise direction in FIG. 1. The second cam 20 is axially slidable on the camshaft 22, and the camshaft 22 is also axially movable but fixed in its rotational direction. In order to limit the axial movement of the second cam 20 relative to the camshaft 22 in the left-hand direction in FIG. 2, there is provided a retaining ring 30 which is fitted into a corresponding groove (no numeral) of the camshaft 22. Against this retaining ring 30, the second cam 20 is pushed by the effect of the return spring 28 and the mating tapered cam contours of the first and second cams 10 and 20.

The rocker arm-engaging cam surface section 24 of the second cam 20 consists of a dwell cam surface portion or a base arc portion 24A which cannot impart a rocking movement to the rocker arm 14 and a rise and return cam surface portion 24B which can impart a rocking movement to the rocker arm 14. The contour of the rise and return cam surface portion 24B is designed such that the valve lift increases with the increasing rotation of the second cam 20 in the counterclockwise direction in FIG. 1.

The camshaft 22 is axially movable and its axial position relative to the first cam 10 is controlled by a control means such as, for example, a hydraulic control device or actuator 32 shown in FIG. 2, which is operatively coupled with the camshaft 22.

The hydraulic control device 32 comprises a cylinder 34 and a piston 36 slidable in the cylinder 34. The piston 36 is bolted or otherwise secured to the end of the camshaft 22 with the axis of the former aligned with that of the latter. On one side of the piston 36 there is located an oil pressure chamber 38 which is fluidly connected to the oil pump (not shown) of the engine which provides lubrication oil to the engine. On the other side of the piston 36 there is located an atmospheric pressure chamber 40 which opens into the air or may be fluidly connected to the oil pan (not shown) of the engine.

With the arrangement thus described of the control device 32, the oil pressure prevailing in the oil pressure chamber 38 tends to urge the piston together with the camshaft 22 in the right-hand direction in FIG. 2 against the counter thrust which is given to the camshaft 22 through the mating tapered cam faces of the first and second cams 10 and 20 from the return spring 28. When the oil pressure in the oil pressure chamber 38 becomes larger and causes the camshaft 22 to move in the right-hand direction in FIG. 2, the second cam 20 correspondingly moves while rotating in the counterclockwise direction in FIG. 1 due to the ramp countours of the first and second cams 10 and 20.

From the above, it will be understood that the control device 32 is operative to control so that the angular position of the second cam 20 is variably determined to be proportional to the oil pressure from the oil pump of the engine and therefore the engine speed.

Referring to FIGS. 3A and 3B and FIGS. 4A and 4B, the operation of the valve operating mechanism thus far described of this invention will be described.

Figure 3A:
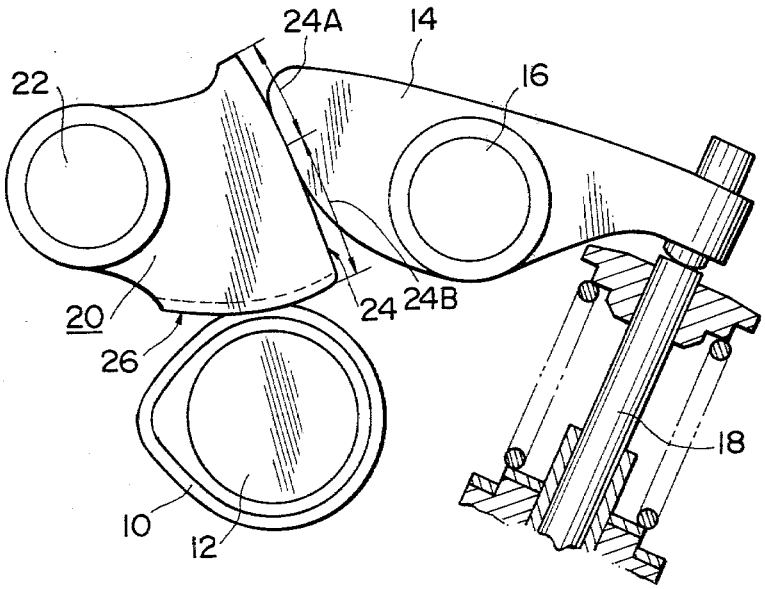
FIGS. 3A and 3B and FIGS. 4A and 4B are front elevations showing the various operating conditions of the valve operating mechanism of FIGS. 1 and 2.
Figure 3B:
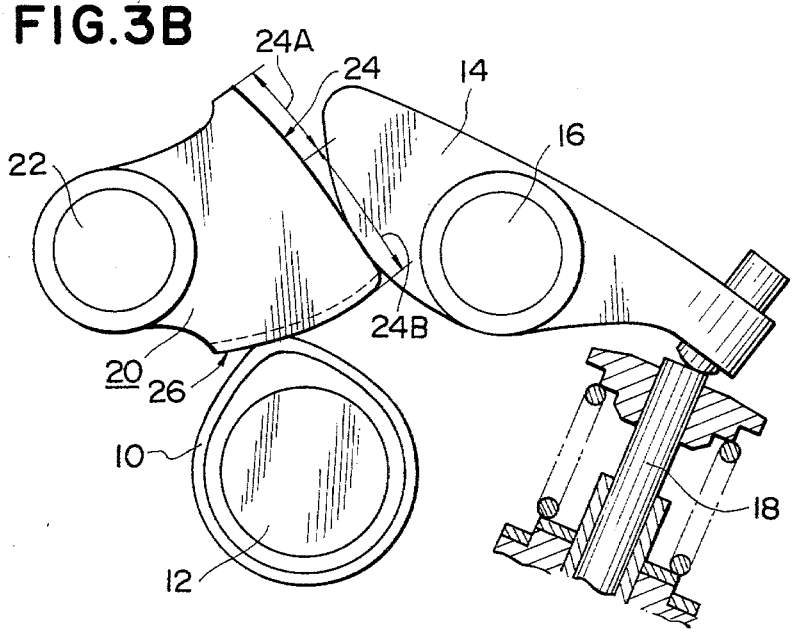

FIGS. 3A and 3B show the operating conditions of the valve operating mechanism in which the camshaft 22 is moved into the most rightward position so that the second cam 20 is maintained at its most rightward possible position in FIG. 2 and in which the valve lift becomes largest.

More particularly, shown in FIG. 3A is the operating condition in which the second cam 20 is about to be driven by the first cam 10 to impart a rocking movement to the rocker arm 14, i.e., a state just before the transition of the second cam-engaging position of the first cam 20 from its dwell cam surface portion 24A to its cam lobe portion 24B, the dwell cam surface portion being incapable of imparting a rocking movement to the second cam while on the other hand the cam lobe portion being capable of imparting a rocking movement to the second cam. In this operating condition of the valve operating mechanism, the rocker arm-engaging position of the second cam 20 is located at its dwell cam surface portion 24A. Just after this operating condition, in response to clockwise rotation of the first cam 10, the valve operating mechanism is placed into the condition in which the rocker arm 14 begins to impart a lifting movement to the valve 18 in such a manner that the valve lift increases with increasing rotation of the first cam 10 in the clockwise direction in the drawing and therefore with increasing rotation of the second cam 20 in the counterclockwise direction in the drawing.

As will be readily understood to those skilled in the art, the valve 18 is maintained in the closed condition during engagement of the rocker arm 14 with the dwell cam surface portion 24A of the second cam 20.

Shown in FIG. 3B is the operating condition of the valve operating mechanism in which the second cam 20 assumes a nearly maximum inclined position through rotation about the axis of rocking movement thereof and imparts a nearly maximum rocking movement to the rocker arm 14 and in which the valve lift becomes nearly maximum.

Thence, when the first cam 10 further rotates in the clockwise direction in the drawing, the second cam 20 correspondingly rotates in the clockwise direction allowing a counterclockwise rotative movement of the rocker arm 14 under the bias of the valve spring (no numeral). Such rotation of the rocker arm 14 results in a gradual decrease of the valve lift. When the second cam 20 then returns to the position where the rocker arm 14 is initiated to engage with the dwell cam surface portion 24A of the cam surface section 24, the valve 18 is put into the closed condition.

Thence, during further rotation of the first cam 10 until it assumes the position shown in FIG. 3A, the dwell cam surface portion 24A is kept engaged with the rocker arm 14 though the second cam 20 further rotates slightly in the clockwise direction at the initial stage during this time. As a result, the rocking movement of the rocker arm 14 does not occur during this time, and therefore the valve 18 is maintained in the closed condition.

Figure 4A:
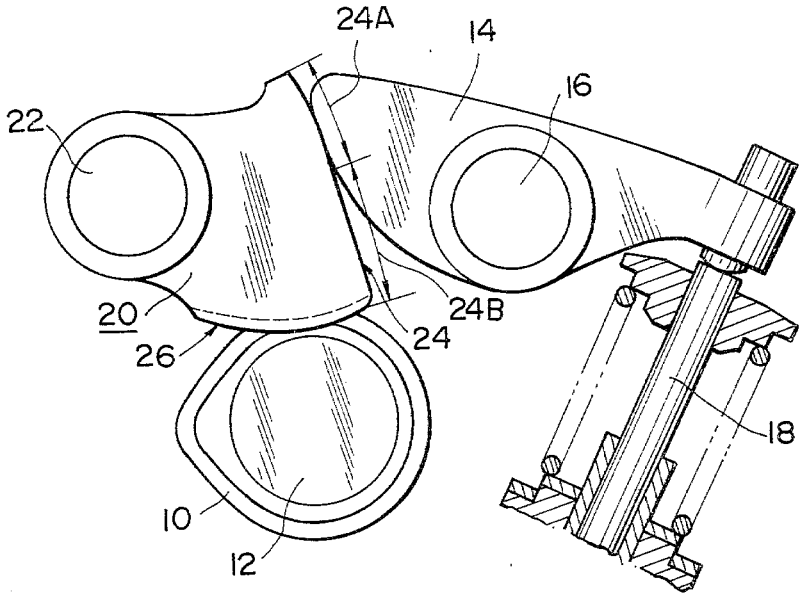
Figure 4B:
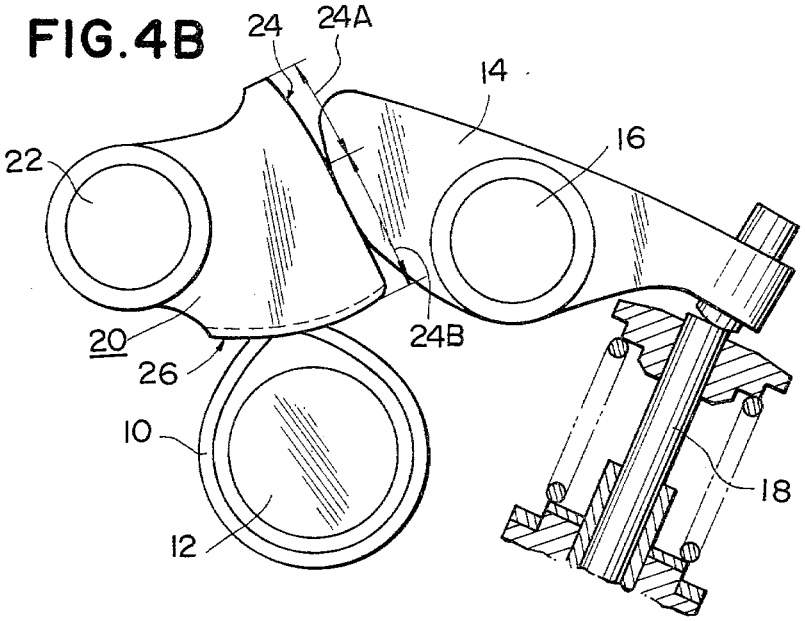

Referring next to FIGS. 4A and 4B, there are shown the operating conditions of the valve operating mechanims in which the camshaft 22 is moved into the most leftward position in FIG. 2 so that the second cam 20 is maintained at the most leftward possible position in the drawing and in which the valve lift becomes smallest.

In these operating conditions, since the second cam 20 is conditioned to engage with a relatively small circumference portion of the first cam 10 with respect to that of FIGS. 3A and 3B, the second cam 20 assumes a relatively clockwise displaced position since the leftward movement of the camshaft 22 allows the second cam 20 to rotate in the clockwise direction under the bias of the return spring 18 until the cam surface section 26 abuttingly engages with the first cam 10. As a result, the effective angular range of the dwell cam surface portion 24A of the second cam 20 becomes larger. That is, even in the operating condition corresponding to the condition just after that of FIG. 3A, in which the first cam 10 is imparting a rocking movement to the second cam 20, the rocker arm 14, which is still in the state of engaging with the dwell cam surface portion 24A of the second cam 20, does not impart a rocking movement to the rocker arm 14. In other words, when the camshaft 22 assumes a more leftward position in FIG. 2, the second cam 20 carries out a lost motion for a longer period during which the second cam 20 rotates without imparting a rocking movement to the rocker arm 14.

When, however, the second cam 20 assumes its angular position in which the rise and return cam surface portion 24B is initiated to engage with the rocker arm 14, the second cam 20 begins to impart a rocking movement to the rocker arm 14 which in turn imparts a lifting movement to the valve 18. The valve lift becomes maximum when the valve operating mechanism is put into the condition shown in FIG. 4B.

In this instance, it will be understood that the amount of maximum valve lift obtained in the case of FIG. 4B is substantially reduced as compared to that in the case of FIG. 3B and that the amount of maximum valve lift changes with the variation of the initial phase or angular position of the second cam 20, the initial phase or angular position being intended to indicate the angular position into which the second cam 20 is put when the first cam 10 is kept engaged at its base circle portion with the second cam 20.

After the operating condition of FIG. 4B, the valve operating mechanism is placed in the operating condition in which the first cam 10 is initiated to engage at its base circle portion with the second cam 20 thereby permitting the valve 18 to be put into the closed condition. In this instance, it will be understood that the period during which the valve 18 is open becomes shorter as compared with that in the case of FIGS. 3A and 3B, i.e., the opening and closing timings of the valve 18 are respectively retarded and advanced as compared with those in the case of FIGS. 3A and 3B.

Figure 5:
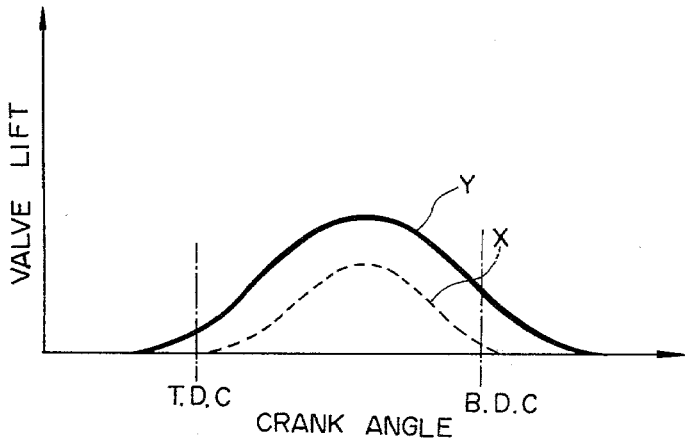
FIG. 5 is a graph showing an example of the performance characteristics of the valve controlled by the valve operating mechanism according to the present invention.

By selectively changing the axial and angular positions of the second cam 20 relative to the first cam 10 through axial displacement of the camshaft 22, the valve operating mechanism of this invention can variably control the valve lift, the valve opening and closing timing and the valve opening period as shown in FIG. 5. FIG. 5 shows an example of the performance characteristics of the valve 18 operated by the valve operating mechanism according to this invention, the valve being assumed to be an intake valve of an internal combustion engine in this example. The curve X corresponds to a low engine speed operation, and the curve Y corresponds to a relatively higher engine speed operation.

In the foregoing, as an alternative to the arrangement in which the movable camshaft 22 for the second cam 10 is coupled with the control device 32, such an arrangement may be available that the camshaft for the first cam is axially movable and coupled with the control device so that the first cam is movable relative to the second cam in response to variation of the engine operating condition.

From the above, it will be understood that in the case where the valve operating mechanism according to the present invention is applied to operate an intake valve of an internal combustion engine, the throttle valve of the engine can be eliminated since the valve operating mechanism having such performance characteristics as shown in FIG. 5 is capable of controlling the induction of the engine without employing the throttle valve thereby preventing the so-called "pumping loss" resulting from the throttle valve in a part throttle operating condition.

It will be further understood that the valve operating mechanism according to the present invention can be utilized to operate an exhaust valve of an internal combustion engine as well as the intake valve.

Obviously, many variations and modifications of the present invention are possible in light of the above teachings. It is, therefore, to be understood that within the scope of appended claims the invention may be practiced otherwise than as specifically described.

What is claimed is:

1. In a valve operating mechanism for the valve of an internal combustion engine, having a first cam rotatable about an axis in timed relation to the engine speed, a rocker arm operatively engaged with the engine valve and rockable to open and control closing of said valve, and a second cam rockable about an axis parallel to the axis of said first cam and interposed between said first cam and said rocker arm to provide an operative connection therebetween, said first and second cams having mating cam faces which taper axially thereof, the improvement comprising: one of said cams being mounted for axial movement on an axially movable camshaft, a retaining ring attached to said camshaft to limit the axial movement of said one cam in one direction thereon, said one cam being pushed against said retaining ring by the effect of said mating tapered cam faces and by a return spring so that said one cam is movable together with said camshaft, and means responsive to variations in engine operating conditions for axially shifting said camshaft and said one cam in relation to said other cam, thereby varying the angular position of said one cam relative to said other cam independently of angular movement of said other cam.

2. A valve operating mechanism of an internal combustion engine comprising a first cam rotatable about an axis in timed relation to the engine speed, a rocker arm operatively engaged with the valve of the engine and rockable to open and control closing of said valve, a second cam rockable about an axis parallel to the axis of said first cam and interposed between said first cam and said rocker arm to provide an operative connection therebetween, said first and second cams having mating cam faces which taper axially thereof, and means for shifting one of said first and second cams axially thereof relative to the other thereby varying the angular position of said second cam independently of that of said first cam in response to variation of the engine operating condition, in which said shifting means comprises a camshaft which is arranged axially movable and on which said second cam is journaled, a retaining ring attached to said camshaft to limit the axial movement of said second cam in one direction thereof, said second cam being pushed against said retaining ring by the effect of said tapered cam faces of said first and second cams and by a return spring so that said second cam is movable together with said camshaft, and a control device controlling the axial position of said camshaft and therefore of said second cam in accordance with the engine speed.

3. A valve operating mechanism as claimed in claim 2, in which said return spring is positioned around said camshaft and has its ends attached to said second cam and said camshaft, respectively.

* * * * *